US006481831B1

(12) United States Patent
Davis et al.

(10) Patent No.: US 6,481,831 B1
(45) Date of Patent: Nov. 19, 2002

(54) FLUID EJECTION DEVICE AND METHOD OF FABRICATING

(75) Inventors: Colin C. Davis, Corvallis, OR (US); Eric L. Nikkel, Philomath, OR (US); Martha A. Truninger, Corvallis, OR (US); Ronald L. Enck, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/611,810

(22) Filed: Jul. 7, 2000

(51) Int. Cl.[7] ..... B41J 2/05
(52) U.S. Cl. ..... 347/62; 347/63
(58) Field of Search ..... 347/61, 63, 62

(56) References Cited

U.S. PATENT DOCUMENTS

| | | | | |
|---|---|---|---|---|
| 4,513,298 A | | 4/1985 | Scheu | |
| 4,535,343 A | | 8/1985 | Wright et al. | |
| 4,602,421 A | | 7/1986 | Lee et al. | |
| 4,862,197 A | | 8/1989 | Stoffel | |
| 5,075,250 A | * | 12/1991 | Hawkins et al. | 430/320 |
| 5,159,353 A | | 10/1992 | Fasen et al. | |
| 5,159,430 A | | 10/1992 | Manning et al. | |
| 5,232,865 A | | 8/1993 | Manning et al. | |
| 5,330,930 A | | 7/1994 | Chi | |
| 5,364,743 A | * | 11/1994 | O'Neill | 430/320 |
| 5,500,553 A | | 3/1996 | Ikegami | |
| 5,744,846 A | | 4/1998 | Batra et al. | |
| 5,870,121 A | | 2/1999 | Chan | |
| 5,883,650 A | | 3/1999 | Figueredo et al. | |
| 5,981,329 A | | 11/1999 | Batra et al. | |
| 5,998,276 A | | 12/1999 | Batra et al. | |
| 6,008,082 A | | 12/1999 | Rolfson et al. | |
| 6,079,811 A | | 6/2000 | Cornell et al. | |

FOREIGN PATENT DOCUMENTS

| | | |
|---|---|---|
| EP | 0 603 821 A2 | 6/1994 |
| EP | 0 674 995 A2 | 10/1995 |

* cited by examiner

*Primary Examiner*—Huan Tran
*Assistant Examiner*—Michael S Brooke

(57) ABSTRACT

An inkjet printhead and a method of fabricating an inkjet printhead is disclosed. The inkjet printhead includes a conducting material layer deposited on an insulative dielectric. The conducting material layer has a chamber formed between a first and a second section of the conducting material layer. A dielectric material is fabricated on the first and second sections of the conducting material layer and on the insulative dielectric in the chamber. The dielectric material has a planarized top surface. A first via is formed in the dielectric material, thereby exposing a portion of the first section of the conducting material layer. A second via is formed in the dielectric material, thereby exposing a portion of the second section of the conducting material layer. The first and second vias each having sidewalls sloped at an angle in the range of approximately 10–60 degrees. A resistive material layer is formed in the first and second vias and on the planarization dielectric between the first and second vias through a single photoresist mask and a single etch process. A passivation material layer is formed onto the planarization dielectric material and onto the resistive material layer.

28 Claims, 6 Drawing Sheets

FLUID EJECTION DEVICE AND METHOD OF FABRICATING

THE FIELD OF THE INVENTION

This invention relates to the manufacturer of printheads used in inkjet printers, and more specifically to an inkjet printhead used in an inkjet print cartridge having improved dimensional control and improved step coverage.

BACKGROUND OF THE INVENTION

One type of inkjet printing system uses a piezoelectric transducer to produce a pressure pulse that expels a droplet of ink from a nozzle. A second type of inkjet printing system uses thermal energy to produce a vapor bubble in an ink-filled chamber that expels a droplet of ink. The second type is referred to as thermal inkjet or bubble jet printing systems.

Conventional thermal inkjet printers include a print cartridge in which small droplets of ink are formed and ejected towards a printing medium. Such print cartridges include inkjet printheads with orifice plates having very small nozzles through which the ink droplets are ejected. Adjacent to the nozzles inside the inkjet printhead are ink chambers, where ink is stored prior to ejection. Ink is delivered to the ink chambers through ink channels that are in fluid communication with an ink supply. The ink supply may be, for example, contained in a reservoir part of the print cartridge.

Ejection of an ink droplet through a nozzle may be accomplished by quickly heating a volume of ink within the adjacent ink chamber. The rapid expansion of ink vapor forces a drop of ink through the nozzle. This process is commonly known as "firing." The ink in the chamber may be heated with a transducer, such as a resistor, that is aligned adjacent to the nozzle.

In conventional thermal inkjet printhead devices, thin film resistors are used as heating elements. In such thin film devices, the resistive heating material is typically deposited on a thermally and electrically insulating substrate. A conductive layer is then deposited over the resistive material. The individual heater element (i.e., resistor) is dimensionally defined by conductive trace patterns that are lithographically formed through numerous steps including conventionally masking, ultraviolet exposure, and etching techniques on the conductive and resistive layers. More specifically, the critical width dimension of an individual resistor is controlled by a dry etch process. For example, a reactive ion etch process is used to etch portions of the conductive layer not protected by a photoresist mask. The conductive layer is removed and a portion of the resistive layer is exposed. The resistive width is defined as the width of the exposed resistive layer between the vertical walls of the conductive layer. Conversely, the critical length dimension of an individual resistor is controlled by a subsequent wet etch process. A wet etch process is used to produce a resistor having sloped walls defining the resistor length. Sloped walls of a resistor permit step coverage of later fabricated layers.

As discussed above, conventional thermal inkjet printhead devices require both dry etch and wet etch processes. The dry etch process determines the width dimension of an individual resistor, while the wet etch process defines both the length dimension and the necessary sloped walls of the individual resistor. As is well known in the art, each process requires numerous steps, thereby increasing both the time to manufacture a printhead device and the cost of manufacturing a printhead device.

One or more passivation and cavitation layers are fabricated over the conductive and resistive layers and then selectively removed to create a via for electrical connection of a second conductive layer to the conductive traces. The second conductive layer is pattered to define a discrete conductive path from each trace to an exposed bonding pad remote from the resistor. The bonding pad facilitates connection with electrical contacts on the print cartridge. Activation signals are provided from the printer to the resistor via the electrical contacts.

The printhead substructure is overlaid with an ink barrier layer. The ink barrier layer is etched to define the shape of the desired firing chamber within the ink barrier layer. The firing chamber is situated above, and aligned with, the resistor. The ink barrier layer includes a nozzle print cartridge adjacent to each firing chamber.

In direct drive thermal inkjet printer designs, the thin film device is selectively driven by the above-described thermal electric integrated circuit part of the printhead substructure. The integrated circuit conducts electrical signals directly from the printer microprocessor to the resistor via the two conductive layers. The resistor increases in temperature and creates super-heated ink bubbles for ejection from the chamber through the nozzle. However, conventional thermal inkjet printhead devices suffer from inconsistent and unreliable ink drop sizes and inconsistent turn on energy required to fire an ink droplet.

It is desirous to fabricate an inkjet printhead capable of producing ink droplets having consistent and reliable ink drop sizes. In addition, it is desirous to fabricate an inkjet printhead having a consistent low turn on energy (TOE) required to fire an ink droplet, thereby providing greater control of the size of the ink drops.

SUMMARY OF THE INVENTION

One aspect of the present invention provides a fluid ejection apparatus, such as a printhead, including an insulative dielectric and first and second conductors disposed on the insulative dielectric. A space is formed between the first and second conductors. A dielectric material is fabricated on top of the first and second conductors and in the space. A first via is formed in the dielectric material adjacent the first conductor. A second via is formed in the dielectric material adjacent the second conductor. A resistive material layer is fabricated on top of the dielectric material. A first electrical connection to the resistive material layer is formed with the first conductor in the first via. A second electrical connection to the resistive material layer is formed with the second conductor in the second via.

BRIEF DESCRIPTION OF THE DRAWINGS

FIGS. 6–9A are enlarged, cross-sectional, partial views illustrating embodiments of various fabrication steps of the present invention.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention.

The present invention is an inkjet printhead and a method of fabricating an inkjet printhead. The present invention provides numerous advantages over the prior art. First, the present invention provides a design capable of firing an ink droplet in a direction substantially perpendicular to the resistive element. Second, the dimensions and planarity of the resistive material layer are precisely controlled, which both standardizes and minimizes the turn on energy required to fire an ink droplet. Third, the size of an ink droplet can be standardized for optimal quality and consistency.

Figure 1:
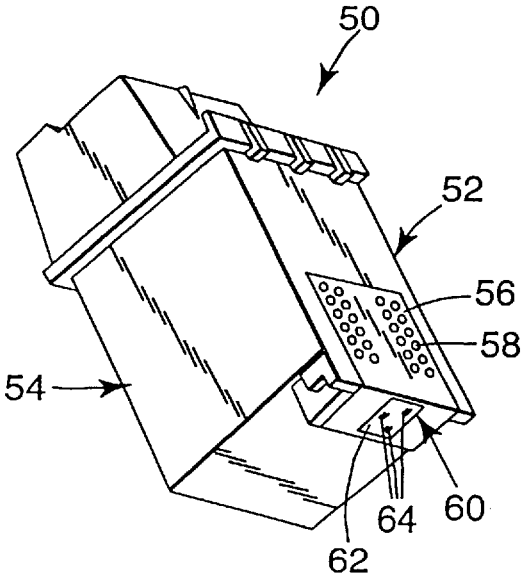
FIG. 1 is a perspective view of an inkjet printer print cartridge.

Exemplary thermal inkjet print cartridge 50 is illustrated in FIG. 1. The inkjet printhead device of the present invention is a portion of thermal inkjet print cartridge 50. Thermal inkjet print cartridge 50 includes body 52, flexible circuit 56 having circuit pads 58, printhead 60 having orifice plate 62, and minute nozzles 64. Ink is provided to inkjet print cartridge 50 via housing 54 configured in fluid connection with inkjet print cartridge 50 or via a remote storage source in fluid connection with inkjet print cartridge 50. While flexible circuit 56 is shown in FIG. 1, it is understood that other electrical circuits known in the art may be utilized in place of flexible circuit 56 without deviating from the present invention. It is only necessary that electrical contacts are in electrical connection with circuitry of inkjet print cartridge 50. Printhead 60 having orifice plate 62 is fit into the bottom of body 52 and controlled for ejection of ink droplets. Thermal inkjet print cartridge 50 includes minute nozzles 64 through which ink is expelled in a controlled pattern during printing.

Each nozzle 64 is in fluid communication with firing chamber 66 (shown enlarged in FIG. 2) defined in printhead 60 adjacent to the nozzle. Each firing chamber 66 is constructed adjacent to a part of thin film printhead substructure 68 that includes a transistor, preferably a resistor component. The resistive component is selectively driven (heated) with sufficient electrical current to instantly vaporize some of the ink in firing chamber 66, thereby forcing an ink droplet through nozzle 64. Conductive drive lines for each resistor component are carried upon flexible circuit 56 mounted to the exterior of print cartridge body 52. Circuit contact pads 58 (shown enlarged in FIG. 1 for illustration) at the ends of the resistor drive lines engage similar pads carried on a matching circuit attached to a printer cartridge (not shown). A signal for firing the transistor is generated by a microprocessor and associated drivers that apply the signal to the drive lines.

Figure 2:
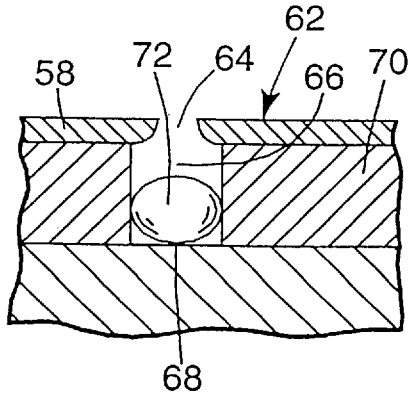
FIG. 2 is an enlarged, cross-sectional, partial view illustrating one embodiment of a thin film printhead substructure.

As shown in FIG. 2, thin film printhead substructure 68 of the present invention has affixed to it ink barrier layer 70, which is shaped to define firing chamber 66. Ink droplet 72 is rapidly heated and fired through nozzle 64.

Figure 3:
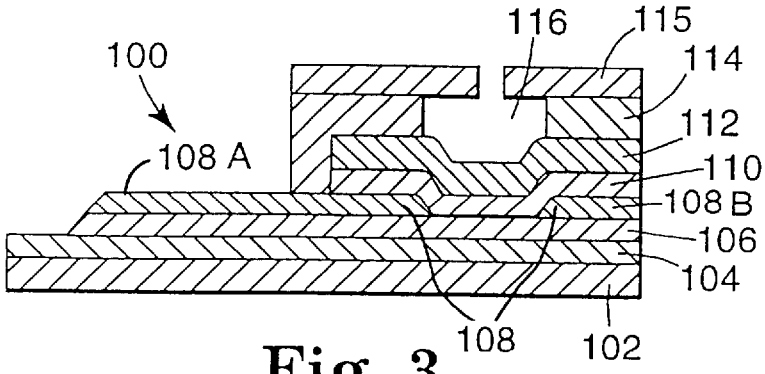
FIG. 3 is an enlarged, cross-sectional, partial view illustrating one embodiment of a thin film printhead substructure.

FIG. 3 is an enlarged, cross-sectional, partial view illustrating thin film printhead substructure 100. Thin film printhead substructure 100 is one example of thin film printhead substructure 68. Thin film printhead substructure 100 includes substrate 102, insulating layer 104, resistive layer 106, conductive layer 108, passivation layer 110, cavitation layer 112, and ink barrier structure 114 defining firing chamber 116. As shown in FIG. 3, relatively thick insulation layer 104 (also referred to as an insulative dielectric) is applied to substrate 102. Silicon dioxides are examples of materials which are used to fabricate insulation layer 104. There are numerous ways to fabricate insulation layer 104, such as through a plasma enhanced chemical vapor deposition (PECVD) or a thermal oxide process. Insulation layer 104 serves as both a thermal and electrical insulator for the circuit which will be built on its surface.

Resistive layer 106 is then applied to uniformly cover the surface of insulation layer 104. Next, conductive layer 108 is applied over the surface of resistive layer 106. In prior art structures, resistive layer 106 and conductive layer 108 are formed from tantalum aluminum and aluminum gold, respectively. A metal used to form conductive layer 108 may also be doped or combined with materials such as copper or silicon. Resistive layer 106 and conductive layer 108 can be fabricated though various techniques, such as through a physical vapor deposition (PVD).

Conductive layer 108 is etched to define conductors 108A and 108B. Conductors 108A and 108B define the critical length and width dimensions of the active region of resistive layer 106. More specifically, the critical width dimension of the active region of resistive layer 106 is controlled by a dry etch process. For example, a reactive ion etch process is used to vertically etch portions of conductive layer 108 which are not protected by a photoresist mask, thereby defining a maximum resistor width as being equal to the width of conductors 108A and 108B. Conversely, the critical length dimension of the active region of resistive layer 106 is controlled by a wet etch process. A wet etch process is used since it is desirable to produce conductors 108A and 108B having sloped walls, thereby defining the resistor length. Sloped walls of conductive layer 108A enables step coverage of layer fabricated layers.

Conductors 108A and 108B serve as the conductive traces which deliver a signal to the active region of resistive layer 106 for firing an ink droplet. Thus, the conductive trace or path for the electrical signal impulse that heats the active region of resistive layer 106 is from conductor 108A through the active region of resistive layer 106 to conductor 108B.

Passivation layer 110 is then applied uniformly over the device. There are numerous passivation layer designs incorporating various compositions. In one prior art embodiment, two passivation layers, rather than a single passivation layer are applied. In the prior art example, the two passivation layers comprise a layer of silicon nitride followed by a layer of silicon carbide. More specifically, the silicon nitride layer is deposited on conductive layer 108 and resistive layer 106 and then a silicon carbide is deposited.

After passivation layer 110 is deposited, cavitation barrier 112 is applied. In the prior art example, the cavitation barrier comprises tantalum. Tantalum may be deposited by a sputtering process, such as a physical vapor deposition (PVD), or other techniques known in the art. Ink barrier layer 114 and orifice layer 115 are then applied to the structure, thereby defining firing chamber 116. In one embodiment, ink barrier layer 114 is fabricated from a photosensitive polymer and orifice layer 115 is fabricated from plated metal or organic polymers. Firing chamber 116 is shown as a substantially rectangular or square configuration in FIG. 3. However, it is understood that firing chamber 116 may include other configurations without varying from the present invention.

Thin film printhead substructure 100, shown in FIG. 3, illustrates one example of a typical prior art printhead. However, printhead substructure 100 requires both a wet and a dry etch process in order to define the functional length and width of the active region of resistive layer 106, as well as the sloped walls of conductive layer 108 necessary for adequate step coverage of later fabricated layers.

Figure 4:
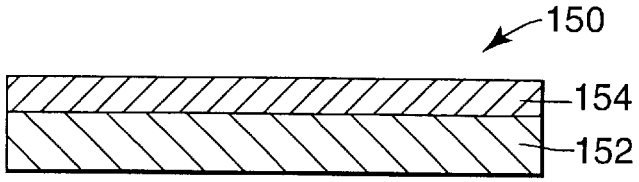
FIGS. 4 and 5A are enlarged, cross-sectional, partial views illustrating an embodiment of various fabrication steps of the present invention.
Figure 5A:
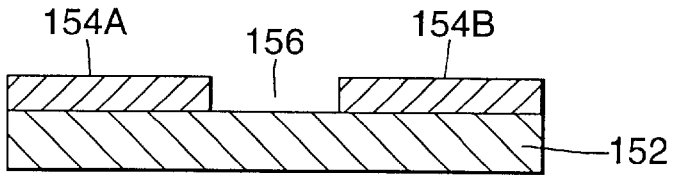
Figure 5B:
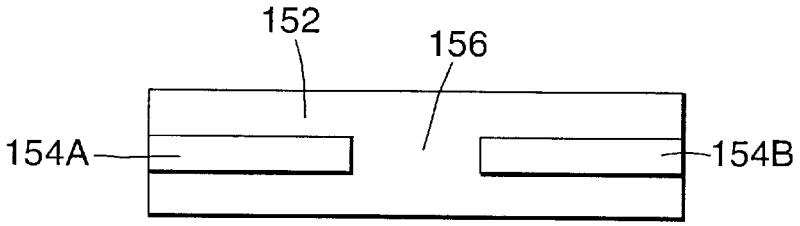
FIG. 5B is an enlarged, plan view illustrating a portion of the cross-sectional view shown in FIG. 5A.

FIGS. 4 and 5A are enlarged, cross-sectional, partial views illustrating the initial layers and fabrication steps for inkjet printhead 150 incorporating the present invention. FIG. 5B is an enlarged, plan view illustrating a portion of inkjet printhead 150 incorporating the present invention. As shown in FIG. 4, insulative dielectric 152 is fabricated through any known means, such as a plasma enhanced chemical vapor deposition (PECVD) or a thermal oxide process. Conductive material layer 154 is fabricated on top of insulative dielectric 152. In one embodiment, conductive material layer 154 is a resistive layer formed through a physical vapor deposition (PVD) from aluminum and copper. More specifically, in one embodiment, conductive material layer 154 includes up to approximately 10 percent copper in aluminum, preferably up to approximately 2 percent copper in aluminum. Utilizing a small percent of copper in aluminum limits electromigration between adjacent thin film layers. In another preferred embodiment, conductive material layer 154 is formed from titanium or tungsten. A photo imagable masking material such as a photoresist mask is deposited on portions of conductive material layer 154, thereby exposing other portions of conductive layer 154. The exposed portions of conductive layer 154 is removed through a dry etch process known in the art. The photoresist mask is then removed, thereby exposing substantially rectangular-shaped conductors 154A and 154B.

Conductors 154A and 154B provide an electrical connection/path between external circuitry and a later formed resistive element. Therefore, conductors 154A and 154B may generate energy in the form of heat capable of firing an ink droplet positioned on a top surface of the later formed resistive element in a direction perpendicular to the top surface of the resistive element. In one preferred embodiment, insulative dielectric 152 is fabricated from silicon dioxide.

As shown in FIG. 5B, conductors 154A and 154B define a chamber area 156 between conductors 154A and 154B. Chamber area 156 has a maximum width equal to the distance between conductors 154A and 154B.

Figure 6:
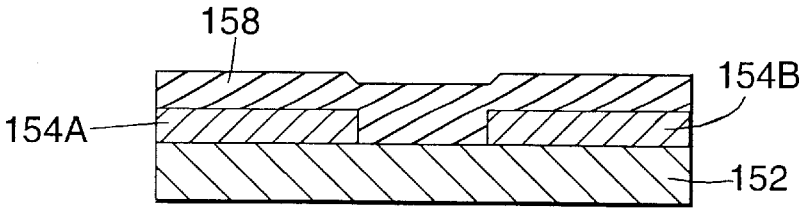

FIGS. 6–9A are enlarged, cross-sectional, partial views illustrating various layers and fabricating steps for inkjet printhead 150. As shown in FIG. 6, dielectric material 158 is deposited onto insulative dielectric 152 in chamber 156 and onto conductors 154A and 154B. As shown in FIG. 6, dielectric material 158 fills chamber area 156. The top surface of dielectric material 158 is then planarized such that the top surface of dielectric material 158 is level (shown in FIG. 7).

In one preferred embodiment, the top surface of dielectric material 158 is planarized through use of a resistive-etch-back (REB) process. In another embodiment, the top surface of dielectric material layer 158 is planarized through use of a chemical/mechanical polish (CMP) process.

In one preferred embodiment, dielectric material 158 is formed from an oxide. More specifically, dielectric material 158 is formed from tetraethylorthosilicate (TEOS) oxide. TEOS oxide provides adequate step coverage, thereby filling chamber area 156 without voids or gaps. In another preferred embodiment, dielectric material 158 is formed from a silicon-containing material or glass. In yet another preferred embodiment, dielectric material 158 has a thickness in the range of approximately 2,000 to 10,000 angstroms above conductors 154A and 154B, and has a thickness in the range of 5,000 to 15,000 angstroms above insulative dielectric 152 within chamber area 156.

Figure 9A:
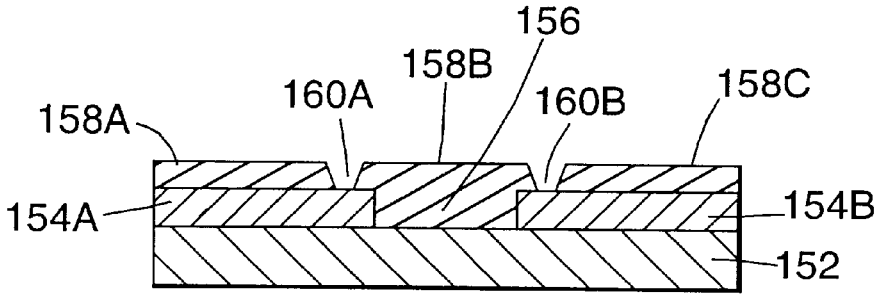
Figure 9B:
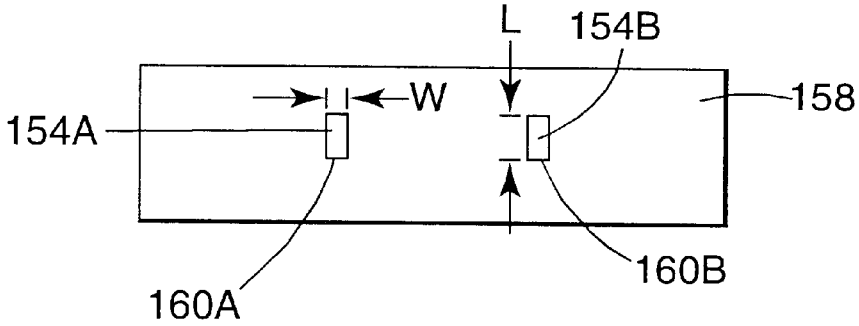
FIG. 9B is an enlarged, plan view illustrating a portion of the cross-sectional view shown in FIG. 9A.

As shown in FIGS. 9A and 9B, vias 160A and 160B are formed through dielectric material 158, thereby exposing a portion of conductors 154A and 154B. As shown in FIG. 9A, vias 160A and 160B substantially divide dielectric material 158 into three distinct sections, 158A, 158B, and 158C. While sections 158A and 158C of dielectric material 158 are located above conductors 154A and 154B, respectively, section 158B of dielectric material 158 is positioned above chamber area 156.

Preferable, the present invention utilizes a dry etch procedure in order to define vias 160A and 160B, as later described. However, a wet etch process may also be used to define vias 160A and 160B. As shown in FIG. 9B, the length of vias 160A and 160B are labeled L and the width of vias 160A and 160B are labeled W. In one embodiment, vias 160A and 160B each have a length L in the range of approximately 10 to 20 microns and a width W in the range of approximately 2 to 10 microns.

In another embodiment, vias 160A and 160B can be subdivided into multiple vias having various dielectric barrier walls providing the structure. Thus, if corrosion occurs within a subdivided portion of vias 160A and 160B, other subportions of vias 160A and 160B will permit an electrical connection between conductors 154A and 154B and resistive material layer 164 (later discussed).

Figure 7:
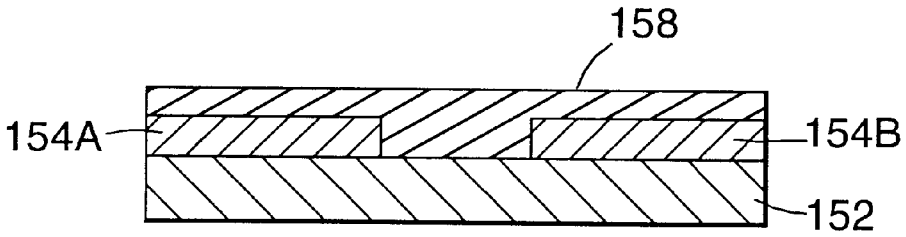
Figure 8:
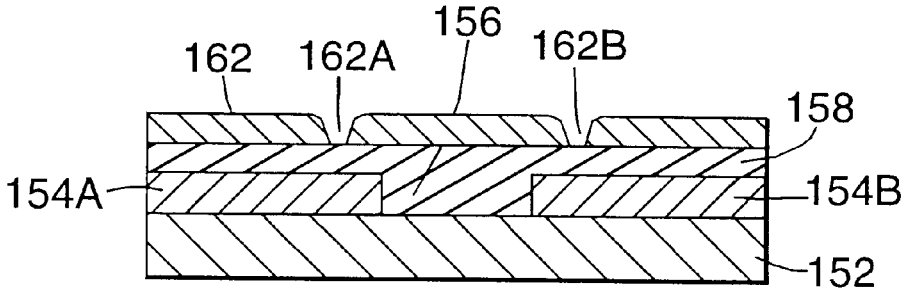
Figure 9C:
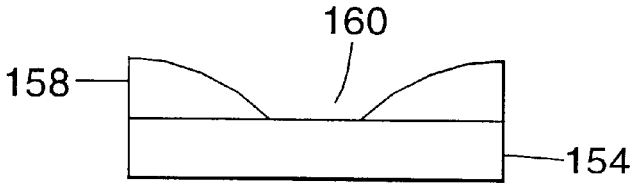
FIG. 9C is an enlarged, cross-sectional, partial view illustrating a portion of the cross-sectional view shown in FIG. 9A.

In order to produced the desired profile shown in FIG. 9C for vias 160A and 160B (singularly shown as via 160 in FIG. 9C), several steps are required. First, the top surface of dielectric material 158 is planarized such that it has a level top surface, as shown in FIG. 7. Photoresist mask 162 is then deposited and defined through standard photolithography techniques, as shown in FIG. 8. Photoresist mask 162 is subject to a high temperature bake process, thereby creating sloped or concave portions of 162A and 162B photoresist mask 162 such that portions of dielectric material 158 are exposed. The exposed portions of dielectric material 158 are then etched through a dry etch process, thereby creating vias 160A and 160B, shown in FIG. 9, having walls sloped in the range of 10–60°, using a vertical plane as a reference. Preferably vias 160A and 160B have sloped walls in the range of approximately 30°–45°. The sloped walls of vias 160A and 160B provide proper step coverage of later fabricated layers. Finally, the remaining portions of photoresist mask 162 is removed.

In one preferred embodiment, photoresist mask 162 is baked at a relatively high temperature, such as greater than 110° Celsius, in order to create sloped or concave portions of 162A and 162B of photoresist mask 162. Preferably, photoresist mask 162 is baked at a temperature of 130° Celsius. Since photoresist mask 162 is a polymer, the polymer flows and produces a curved or sloped profile or concave section immediately above the desired location of vias 160A and 160B, shown in FIG. 9. The angle of the sloped walls of photoresist layer 162 can be controlled through the baking process (i.e., length of time and temperature).

In another embodiment, vias 160A and 160B having sloped walls are formed through a photoresist mask which is deposited and defined, and a dry etch process which changes the selectivity of etch rate between photoresist mask 162 and dielectric material 158 resulting in a sloped profile as is known in the art. In yet another embodiment, the vias having sloped walls can be formed through a photoresist mask and a wet etch process as is known in the art.

Figure 10A:
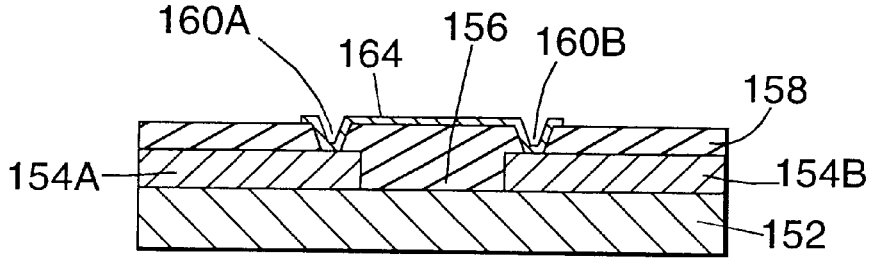
FIG. 10A is an enlarged, cross-sectional, partial view illustrating an embodiment of a fabrication step of the present invention.
Figure 10B:
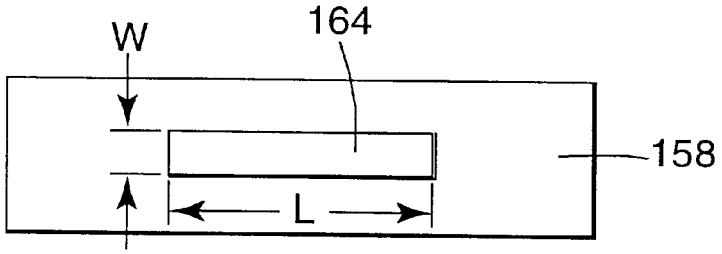
FIG. 10B is an enlarged, plane view illustrating a portion of the cross-sectional view shown in FIG. 10A.

FIGS. 10A and 10B illustrate resistive element 164 fabricated within vias 160A and 160B and above chamber area 156 between vias 160A and 160B. As shown in Figure 10A, resistive element 164 comes in direct contact with conductors 154A and 154B in vias 160A and 160B, respectively. Therefore, conductors 154A and 154B provide an electrical connection between resistive element 164 and circuitry external to inkjet printhead 150. Resistive element 164 is fabricated as shown in FIG. 10 via conventional means, such as a physical vapor deposition. A photoresist mask covers portions of a resistive material layer to define the shape of resistive element 164. Defining resistive element 164 through a single photoresist mask and a single etch is an advantage over the prior art because it provides increased dimensional control of resistive element 164. As shown in Figure 10A, resistive element 164 is fabricated within vias 160A and 160B, as well as on dielectric material 158 between vias 160A and 160B. In one embodiment, resistive element 164 has a thickness in the range of approximately 250 to 1000 angstroms. The sloped walls of dielectric material 158A permit adequate step coverage. If vias 160A and 160B included vertical walls, adequate step coverage is difficult to achieve and voids or gaps provide interconnection issues.

As shown in FIG. 10B, resistive element 164 has a width W. However, it is understood that resistive element 164 may be fabricated having any one of a variety of configurations, shapes, or sizes, such as a thin trace or a wide trace between vias 160A and 160B. The only requirement of the resistive element 164 is that it encloses vias 160A and 160B to ensure a proper electrical connection to conductors 154A and 154B. While the actual length L of resistive element 164 is equal to or greater than the distance between the outer most edges of vias 160A and 160B, the active portion of resistive element 164 which conducts heat to a droplet of ink positioned above resistive element 164 corresponds to the distance between the outermost edges of vias 160A and 160B.

Figure 11:
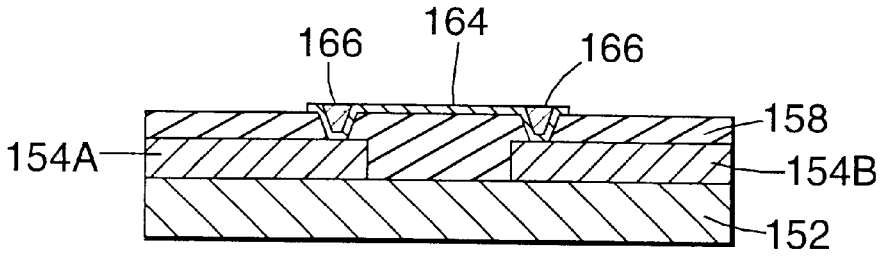
FIG. 11 is an enlarged, cross-sectional, partial view illustrating an alternate embodiment of the present invention.

FIG. 11 is an enlarged, cross-sectional, partial view illustrating an alternate embodiment of the present invention. As shown in FIG. 11, fill or planarization element 166 is fabricated in both vias 160A and 160B on top of resistive element 164 and planarized. In one embodiment, fill element 166 is formed from a conductive material, such as tungsten. In another embodiment, fill element 166 is formed from dielectric material. The addition of fill element 166 minimizes the issue of step coverage for passivation layer 168 (shown in FIGS. 12 and 13).

Figure 12:
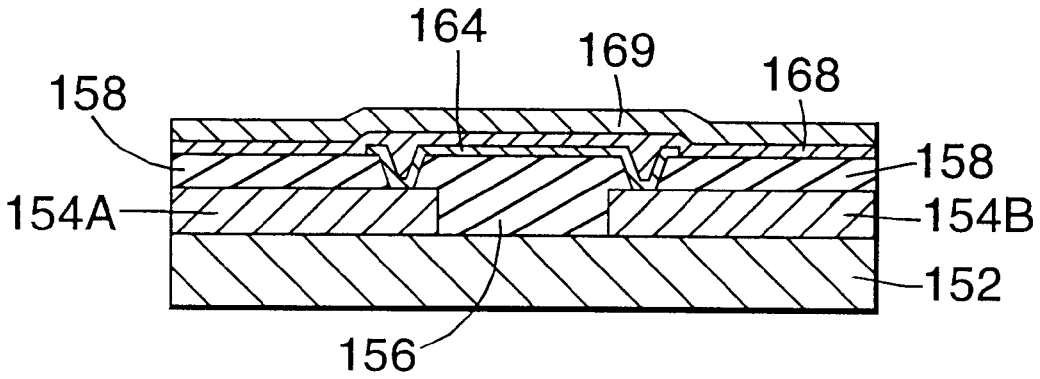
FIGS. 12 and 13 are enlarged, cross-sectional, partial views illustrating embodiments of various fabrication steps of the present invention.

FIG. 12 is an enlarged, cross-sectional view illustrating additional layers and steps of the present invention. As shown in FIG. 12, passivation layer 168 is fabricated on top of resistive material layer 164 and dielectric material 158. Passivation layer 168 can be formed incorporating various compositions as long as it acts as an insulator layer and/or a protective layer. In one embodiment, passivation layer 168 can be an intermetal dielectric. In another embodiment, passivation layer 168 is a silicon-containing layer, while in yet another embodiment, passivation layer 168 is a dielectric layer. It is desirous to utilize a thin passivation layer 168 in order to promote efficiency of inkjet printhead 150. Therefore, in one preferred embodiment, passivation layer 168 has a thickness of less than approximately 5,000 angstroms above resistive material layer 164 between vias 160A and 160B.

Cavitation layer 169 is fabricated on top of passivation layer 168. Cavitation layer 169, which covers passivation layer 168 and resistive material layer 164, eliminates or minimizes mechanical damage to various elements of the overall structure due to the momentum of collapsing an ink bubble. In one preferred embodiment, cavitation layer 169 comprises tantalum, although other materials, such as, for example, tungsten, may be used.

Figure 13:
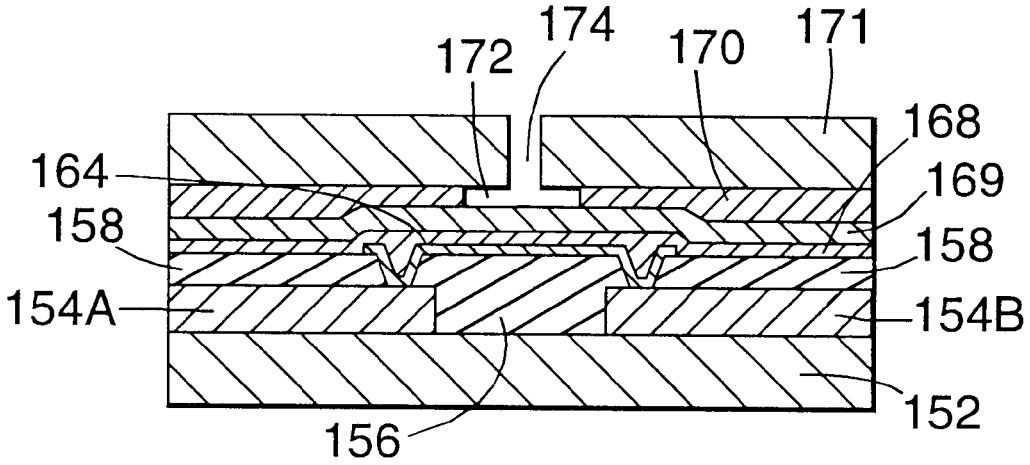

FIG. 13 is an enlarged, cross-sectional view illustrating completed inkjet printhead 150. As shown in FIG. 13, ink barrier layer 170 is fabricated on top of cavitation layer 169 as is known in the art. Ink barrier layer 170 is fabricated such that firing chamber 172 is developed directly above and in alignment with resistive element 164 between vias 160A and 160B.

In operation, a droplet of ink is positioned within chamber 172. Electrical current is supplied to resistive element 164 via conductors 154A and 154B such that resistive element 164 rapidly generates energy in the form of heat. The heat from resistive element 164 is transferred to a droplet of ink within chamber 172 until the droplet of ink is "fired" through nozzle 174. This process is repeated several times in order to produce a desired result.

The present invention provides numerous advantages over the prior art. First, the resistor length of the present invention is defined by the placement of vias 160A and 160B which are fabricated during a combined photo process and dry etching process. The accuracy of the present process is considerably more controllable than prior art wet etch processes. More particularly, the present process is in the range of 10–25 times more controllable than a prior art process. With the current generation of low drop weight, high-resolution printheads, resistor lengths have decreased from approximately 35 micrometers to less than approximately 10 micrometers. Thus, resistors size variations can significantly affect the performance of a printhead. Resistor size variations translate into drop weight and turn on energy variations across the printhead due to the variation of resistor resistance. Thus, the improved length control of the resistive material layer yields a more consistent resistor size and resistance, which thereby improves the consistency in the drop weight of an ink droplet and the turn on energy necessary to fire an ink droplet.

Second, the resistor structure of the present invention includes a completely flat top surface and does not have the step contour associated with prior art fabrication designs. A flat structure provides consistent bubble nucleation, better scavenging of the firing chamber, and a flatter topology, thereby improving the adhesion and lamination of the barrier structure to the thin film. Third, due to the flat topology of the present structure, the barrier structure is allowed to cover the edge of the resistor. By introducing heat into the floor of the entire firing chamber, ink droplet ejection efficiency is improved.

Fourth, the present invention utilizes a single mask and a single etch to fabricate a resistive element, rather than using both a dry and a wet etch process as is known in the art. Vias 160A and 160B of the present invention are formed having desired sloped walls which facilitate enhanced step coverage of later fabricated layers, such as resistive element 164 and passivation layer 168.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A fluid ejection apparatus comprising:

an insulative dielectric;

first and second conductors fabricated on the insulative dielectric, the first and second conductors having a chamber formed therebetween, the first and second conductors each having a width;

a dielectric material fabricated on the first and second conductors and on the insulative dielectric in the chamber;

a first via formed in the dielectric material to expose a portion of the first conductor, the first via having sloped side walls;

a second via formed in the dielectric material to expose a portion of the second conductor, the second via having sloped side walls;

a resistive material layer formed within the first and second vias and on the dielectric material between the first and second vias, the resistive material layer having a length at least as long as a distance between the first and second vias in the dielectric material;

a passivation material layer formed onto the dielectric material and onto the resistive material layer; and a cavitation material layer formed onto the dielectric material and onto the passivation layer.

2. The apparatus of claim 1, wherein the first and second vias each have sloped walls sloped at an angle in the range of approximately 10–60 degrees.

3. The apparatus of claim 1, wherein the first and second conductors include up to approximately 2 percent copper in aluminum.

4. The apparatus of claim 1, wherein the dielectric material is fabricated from tetraethylorthosilicate (TEOS) oxide.

5. The apparatus of claim 1, wherein the first via has a width in the range of approximately 2–10 micrometers and a length in the range of approximately 10–20 micrometers.

6. The apparatus of claim 1, wherein the second via has a width in the range of approximately 2–10 micrometers and a length in the range of approximately 10–20 micrometers.

7. The apparatus of claim 1, wherein the first via has a height in the range of approximately 2,000 to 10,000 angstroms and the second via has a height in the range of approximately 2,000 to 10,000 angstroms.

8. The apparatus of claim 1, wherein the passivation material layer has a thickness of less than approximately 5,000 angstroms.

9. The apparatus of claim 1, wherein the dielectric material above the insulative dielectric has a thickness in the range of approximately 7,000 to 15,000 angstroms.

10. The apparatus of claim 1, wherein the resistive material layer formed between the first and second vias has a thickness in the range of approximately 250 to 1,000 angstroms.

11. The apparatus of claim 1, and further comprising:

a barrier layer having a chamber formed therein between the first and second vias, the chamber located above the resistive layer between the first and second vias.

12. The apparatus of claim 1, wherein the passivation material layer is a silicon-containing layer.

13. The apparatus of claim 1, wherein the passivation material layer is a dielectric layer.

14. The apparatus of claim 1, wherein the insulative dielectric is capable of dissipating heat.

15. The apparatus of claim 1, and further comprising:

a first fill layer formed in the first via prior to forming the resistive material layer; and a second fill layer formed in the second via prior to forming the resistive material layer.

16. The apparatus of claim 1, wherein the first via further comprises:

multiple subdivided via portions formed in the dielectric material.

17. The apparatus of claim 16, wherein the second via further comprises:

multiple subdivided via portions formed in the dielectric material.

18. A printhead comprising:

an insulative dielectric;

first and second conductors disposed on the insulative dielectric having a space formed therebetween;

a resistive material layer defined proximate to the first and second conductors wherein the resistive material layer is fabricated on top of the dielectric material;

a dielectric material fabricated between the first and second conductors and the resistive material layer and in the space formed between the first and second conductors;

a first via formed in the dielectric material between the first conductor and the resistive material layer such that a first electrical connection is formed between the first conductor and the resistive material layer; and a second via formed in the dielectric material between the second conductor and the resistive material layer such that a second electrical connection is formed between the second conductor layer and the resistive material layer.

19. The printhead of claim 18, wherein the first via has sloped side walls in the range of approximately 10–60° and the second via has sloped side walls in the range of approximately 10–60°.

20. The printhead of claim 18, and further comprising:

electrical circuitry in electrical connection with the first and second conductors such that energy is supplied to the resistive material layer capable of firing a fluid droplet in a direction perpendicular to the resistive material layer.

21. The printhead of claim 18, and further comprising:

an insulating layer upon which the first and second conductors are fabricated;

a passivation material layer fabricated on top of the resistive material layer; and a cavitation layer fabricated on top of the passivation material layer.

22. A printhead comprising:

an insulative dielectric;

first and second conductors disposed on the insulative dielectric and having a space formed therebetween;

a dielectric material fabricated on top of the first and second conductors and in the space;

a first via formed in the dielectric material adjacent the first conductor;

a second via formed in the dielectric material adjacent the second conductor; and a resistive material layer fabricated on top of the dielectric material such that a first electrical connection is formed with the first conductor and a second electrical connection is formed with the second conductor.

23. The printhead of claim 22, wherein the first via has sloped side walls in the range of approximately 10–60° and the second via has sloped side walls in the range of approximately 10–60°.

24. The printhead of claim 22, and further comprising:

electrical circuitry in electrical connection with the first and second conductors such that energy is supplied to the resistive material layer capable of firing a fluid droplet in a direction perpendicular to the resistive material layer.

25. The printhead of claim 22, and further comprising:

an insulating layer upon which the first and second conductors are fabricated;

a passivation material layer fabricated on top of the resistive material layer; and a cavitation layer fabricated on top of the passivation material layer.

26. A fluid ejection device having a substrate and an ejection chamber defined thereon, the printhead comprising:

first and second spaced conductors defined proximate the substrate;

a resistive layer defined between the first and second spaced conductors and the ejection chamber with the first and second spaced conductors in electrical contact with the resistive layer so that current passes through the resistive layer to eject fluid from the ejection chamber;

a dielectric layer disposed between the first and second spaced conductors and the resistive layer;

a first via defined in the dielectric layer and in which the first spaced conductor is electrically connected to the resistive layer;

a second via defined in the dielectric layer and in which the second spaced conductor is electrically connected to the resistive layer such that the first spaced conductor connection to the resistive layer in the first via is spaced from the second spaced conductor connection to the resistive layer in the second via.

27. The device of claim 26 further comprising a passivation layer disposed on the resistive layer and a cavitation layer disposed on the dielectric layer.

28. The device of claim 26 wherein the ejection chamber is configured to eject fluid along a direction that is generally orthogonal to the resistive layer.

* * * * *